US005340942A

United States Patent [19]

Kunimoto

[11] Patent Number: 5,340,942

[45] Date of Patent: Aug. 23, 1994

[54] WAVEGUIDE MUSICAL TONE SYNTHESIZING APPARATUS EMPLOYING INITIAL EXCITATION PULSE

[75] Inventor: Toshifumi Kunimoto, Hamamatsu, Japan

[73] Assignee: Yamaha Corporation, Japan

[21] Appl. No.: 10,524

[22] Filed: Jan. 25, 1993

Related U.S. Application Data

[63] Continuation of Ser. No. 755,532, Sep. 5, 1991, abandoned.

[30] Foreign Application Priority Data

Sep. 7, 1990 [JP] Japan ..... 2-237746

[51] Int. Cl.[5] ..... G10H 1/12

[52] U.S. Cl. ..... 84/661; 84/736; 84/DIG. 9; 84/DIG. 10

[58] Field of Search ..... 84/622–625, 84/630, 661, 662, 673, 692–700, 707, 736, 737, DIG. 9, DIG. 10, DIG. 26

[56] References Cited

U.S. PATENT DOCUMENTS

| | | | |
|---|---|---|---|
| 3,767,833 | 10/1973 | Noble et al. | 84/673 |
| 4,815,354 | 3/1989 | Kunimoto | 84/DIG. 9 |
| 4,829,463 | 5/1989 | Kakishita et al. | 84/DIG. 9 |
| 4,984,276 | 1/1991 | Smith | 84/630 X |

FOREIGN PATENT DOCUMENTS

| | | |
|---|---|---|
| 248527 | 4/1987 | European Pat. Off. . |
| 58-58679 | 12/1983 | Japan . |
| 63-40199 | 2/1988 | Japan . |

*Primary Examiner*—Stanley J. Witkowski
*Attorney, Agent, or Firm*—Graham & James

[57] ABSTRACT

A musical tone synthesizing apparatus conducts musical tone synthesis based on the tone generation mechanism of an acoustic musical instrument, and generates quickly and accurately desired musical tones in response to the operation of the beginning of tone generation. The musical tone synthesizing apparatus includes a performance data generation mechanism which generates performance data in accordance with performance operations, an excitation circuit, which generates an excitation signal in correspondence with the performance data, and a signal loop circuit which delays the excitation signal by a fixed period and repeatedly cycles the excitation signal. The performance data generation mechanism, furthermore, supplies an initial excitation control signal, which is for the purpose of exciting the signal loop circuit, to the excitation circuit during the initial generation of a musical tone. Thereby, resonant operation is quickly conducted in accordance with the initial excitation control signal, so that desired musical tones can be swiftly and accurately generated.

5 Claims, 6 Drawing Sheets

WAVEGUIDE MUSICAL TONE SYNTHESIZING APPARATUS EMPLOYING INITIAL EXCITATION PULSE

This is a continuation of copending application Ser. No. 07/755,532 filed on Sep. 5, 1991 and now abandoned.

BACKGROUND OF THE INVENTION

1. Field of the Invention

The present invention relates to a musical tone synthesizing apparatus which generates musical tones which are based on the tone generation mechanism of an acoustic musical instrument.

2. Prior Art

Conventionally, methods of synthesizing the musical tones of an acoustic musical instrument by making a model of the tone generation mechanism of the instrument and simulating this are known. This type of art was disclosed in, for example, Japanese Patent Application, Laid-open publication No. 63-40199 and Japanese Patent Application, second publication, No. 58-58679.

FIG. 10 shows the construction of a musical tone synthesizing apparatus which simulates the tone generation mechanism of a wind instrument as an example of this type of art. In FIG. 10, ROM (Read Only Memory) 11, adder 16, subtracter 13, and multipliers 14 and 15 are shown. These component elements 13–16 comprise excitation circuit 10. This excitation circuit 10 simulates the operation of the mouthpiece and the reed in a wind instrument such as a clarinet or the like.

Bidirectional transmission circuit 20 simulates the transmission characteristics of the resonance tube in the body of a wind instrument. This bidirectional transmission circuit 20 comprises delay circuits $D_1$, $D_2$, $D_m$, $D_{m+1}$, . . . , $D_{n-1}$, $D_n$, which simulate the propagation delay of the air pressure waves in the resonance tube, junctions JU, JU . . . , which are inserted between these delay circuits, low pass filter LPF, which simulates the loss, etc., of energy at the time of the reflection of the air pressure waves at the end of the resonance tube, and high pass filter HPF, which obstructs the direct current component of the data transmitted within bidirectional transmission circuit 20.

Junctions JU, JU . . . , simulate the dispersion of the air pressure waves generated at the points where the diameter of the resonance pipe changes. The junctions JU, JU . . . , shown in FIG. 10 use a 4-multiplication lattice comprising multipliers $M_1$–$M_4$ and adders $A_1$ and $A_2$. The symbols "1+k", "−k", "1−k" and "k" which are attached to the multipliers $M_1$–$M_4$ are coefficients of multiplication. The value of k in these coefficients of multiplication is so set that transmission characteristics which are almost equivalent to those in an actual resonance tube are obtained.

With the above described construction, the data P which correspond to the pressure which the player puts into the wind instrument are inputted into the adder 16 and the subtracter 13. Furthermore, the data outputted by adder 16 are transmitted within bidirectional transmission circuit 20 in the following manner: delay circuit D→junction JU→delay circuit D→. . . , and reach low pass filter LPF. Next, after passing through low pass filter LPF and high pass filter HPF, the data are transmitted in the opposite direction from the above, from delay circuit D→junction JU→. . . , are outputted from bidirectional transmission circuit 20 and are inputted into subtracter 13. It is here that the data outputted by bidirectional transmission circuit 20 are made to correspond to the pressure of the air pressure waves which return from the end of-the resonance tube in a wind instrument to the space between the reed and the mouthpiece.

Next, subtracter 13 subtracts data P from the data outputted by bidirectional transmission circuit 20. By means of this subtraction, data $P_1$, which correspond to the air pressure in the gap between the reed and the mouthpiece, are obtained. The data $P_1$ are supplied to ROM 11. ROM 11 outputs data Y, which represent the cross section of the gap between the reed and the mouthpiece corresponding to data $P_1$; or which, in other words, correspond to the admittance with respect to the flow of air.

FIG. 11 shows an example of a nonlinear function A which is stored in ROM 11. This nonlinear function A shows the cross section (output) of the gap between a reed and a mouthpiece corresponding to the air pressure (input) within the gap between the reed and the mouthpiece. Furthermore, data Y, which are outputted from ROM 11, and data $P_1$ are multiplied by means of multiplier 14. By means of this, the data FL, which correspond to the flow velocity of the air which passes through the space between the reed and the mouthpiece, are obtained.

The data FL are multiplied by coefficient of multiplication G by means of multiplier 15. This coefficient of multiplication G is a constant determined in correspondence with the tube diameter in the vicinity of the place where the reed is attached in the wind instrument, and corresponds to the resistance to the air flow, in other words, to the impedance with respect to the air flow. Accordingly, the product of the flow velocity of the air flow which passes through the space between the mouthpiece and the reed and the impedance with regard to the air flow in the tube, in other words, the data $P_2$ which correspond to the component of the change in pressure within the tube which is caused by the air flow passing through the space, is outputted by multiplier 15. Furthermore, these data P2 and data P are added by means of adder 16 and are inputted into bidirectional transmission circuit 20.

In this way, data circulate in the closed loop formed by excitation circuit 10 and bidirectional transmission circuit 20, and resonant operation is achieved. In addition, data are retrieved from the point of connection of the low pass filter LPF of the bidirectional transmission circuit 20 which is in resonant operation, and based on these data musical tones are generated.

However, in the conventional musical tone synthesizing apparatus described above, the amount of time from the input of data P to the stabilization of the resonant operation in the closed loop may be large. In this case, there is a problem in that it takes a great deal of time before a stable musical tone signal can be obtained.

Furthermore, in the loop circuit formed by excitation circuit 10 and bidirectional transmission circuit 20, the resonance characteristics have a number of differing resonance frequencies. If there is no profitable difference in these resonance frequencies, it is unclear at which resonance frequency resonance should be achieved, and it becomes difficult to cause resonance at the desired resonance frequency. Accordingly, in this case, there is a problem in that it may not be possible to obtain the desired musical tone.

SUMMARY OF THE INVENTION

It is accordingly an object of the present invention to provide a musical tone synthesizing apparatus which makes possible the conduction of musical tone synthesis based on the actual tone generation mechanism of an acoustic musical instrument while also making possible the swift, with respect to the beginning of musical tone operation, and certain generation of musical tones.

Accordingly, the present invention is provided with an operation element, which generates performance data in accordance with performance operations, an excitation mechanism, which generates an excitation signal corresponding to this performance data, and a tone source, which has a resonance system which delays this excitation signal by a predetermined period and repeatedly cycles it and which outputs the output of the resonance system as a musical tone signal; the excitation mechanism supplies an initial signal which excites the resonance system to the tone source at the beginning of generation.

In accordance with the above construction, an initial excitation control signal for the purpose of exciting the signal loop mechanism is supplied to the excitation mechanism by the performance data generation mechanism at the time of the beginning of generation of a musical tone signal. By means of this, resonant operation can be conducted promptly in accordance with the initial excitation control signal.

DETAILED DESCRIPTION OF THE PREFERRED EMBODIMENTS

First Preferred Embodiment

Figure 1:
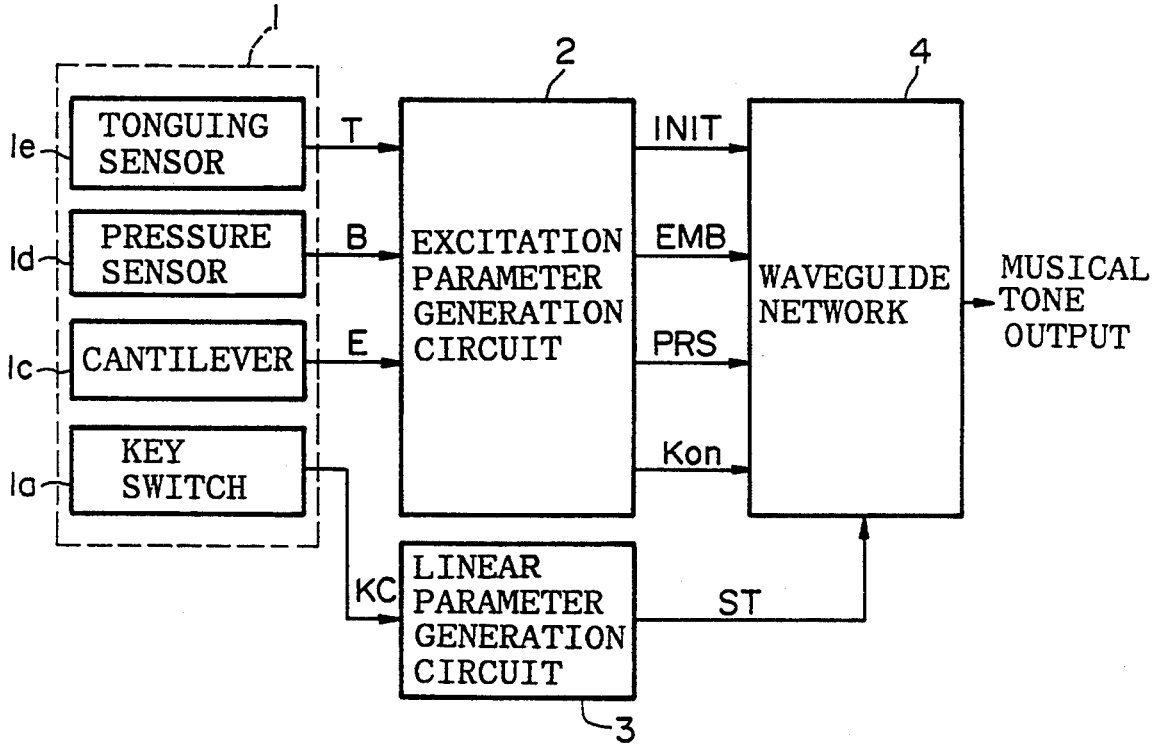
FIG. 1 is a block diagram showing the electronic construction of a musical tone synthesizing apparatus in accordance with the present invention.

Hereinbelow, preferred embodiments of the present invention will be explained with reference to the diagrams. FIG. 1 is a block diagram showing the electronic construction of a musical tone synthesizing apparatus in accordance with a preferred embodiment of the present invention. In the diagram, reference numeral 1 indicates a woodwind musical instrument type operational element, which simulates a woodwind musical instrument such as a clarinet or the like; it outputs various types of signals in accordance with the operation of a performer. Here, the construction of woodwind musical instrument type operational element 1 will be explained with reference to FIGS. 2 and 3.

Figure 2:
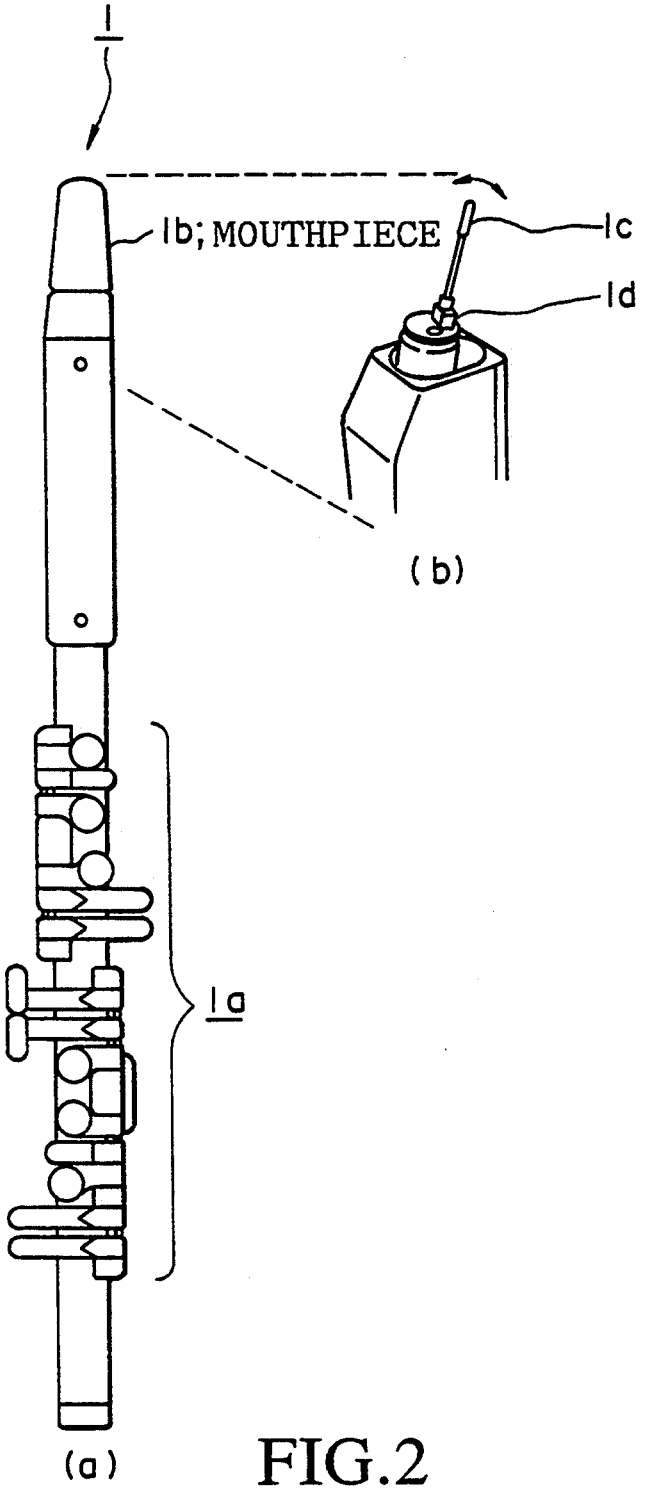
FIG. 2 is a outer view drawing showing an example of woodwind musical instrument type operational element 1 in the same preferred embodiment.

First, FIG. 2(*a*) is a outer view drawing showing an example of this woodwind musical instrument type operational element 1. In the drawing, reference numeral 1*a* indicates a key switch which generates a key code Kc. Reference numeral 1*b* indicates a mouthpiece. Within this mouthpiece 1*b*, a cantilever 1*c* and a pressure sensor 1*d* are provided as shown in FIG. 2(*b*).

Cantilever 1*c* detects the pressure (this pressure is termed embouchure) which is placed on the reed when the player places mouthpiece 1*b* in his mouth; this is outputted as embouchure signal E. On the other hand, pressure sensor 1*d* detects the breath pressure which is created within mouthpiece 1*b*, and outputs this as playing pressure signal B. Furthermore, within this mouthpiece 1*b*, a tonguing sensor 1*e* is disposed. Here, what is meant by tonguing is a playing operation in which the flow of air is interrupted by means of the "tongue" of the player. The tonguing sensor 1*e* detects the displacement of the "tongue" during this type of playing operation.

Figure 3:
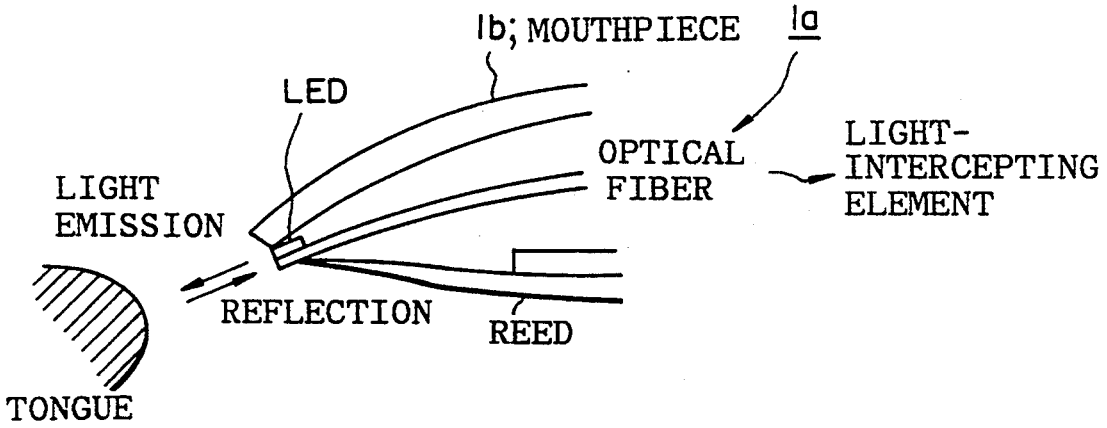
FIG. 3 is a cross sectional drawing showing the construction of tonguing sensor 1e in the same preferred embodiment.

FIG. 3 is a cross sectional view showing an example of the construction of this tonguing sensor 1*e*. The tonguing sensor 1*e* shown in this diagram comprises LEDs and optical fiber light intercepting surfaces disposed between mouth piece 1*b* and the reed, and a light intercepting element connected to the end of this optical fiber. In accordance with this structure, the light emitted from the LEDs is reflected by the "tongue", and this reflected light is received by the light intercepting element through the medium of the optical fiber. As a result, the strength of the reflected light varies in correspondence with the position of the "tongue", so that it is possible to obtain a tonguing signal T corresponding to the distance between the "tongue" and the optical fiber light intercepting surface. For example, as the "tongue" gradually approaches the optical fiber light intercepting surface, and then moves away from this surface again, a tonguing signal T which varies in the way shown in FIG. 4(*a*) is obtained.

Next, the construction of the musical tone synthesizing apparatus will be explained with reference to FIG. 1. Reference numeral 2 indicates an excitation parameter generation circuit which generates and outputs musical tone control data in accordance with the embouchure signal E, playing pressure signal B, and tonguing signal D which are supplied from woodwind musical instrument type operational element 1. These musical tone control data include the initial data INIT, embouchure data EMB, playing pressure data PRS, and key on signal Kon, which are described hereinafter. Reference numeral 3 indicates a linear parameter generation circuit; it converts the key code Kc supplied from woodwind musical instrument type operational element 1 into data ST, which control the pitch of the generated musical tones, and outputs these data. Reference numeral 4 indicates a waveguide network. This waveguide network 4 simulates the operational characteristics of the woodwind musical instrument in accordance with the above-described musical tone control data and data ST, and outputs the synthesis data obtained as a result.

Figure 5:
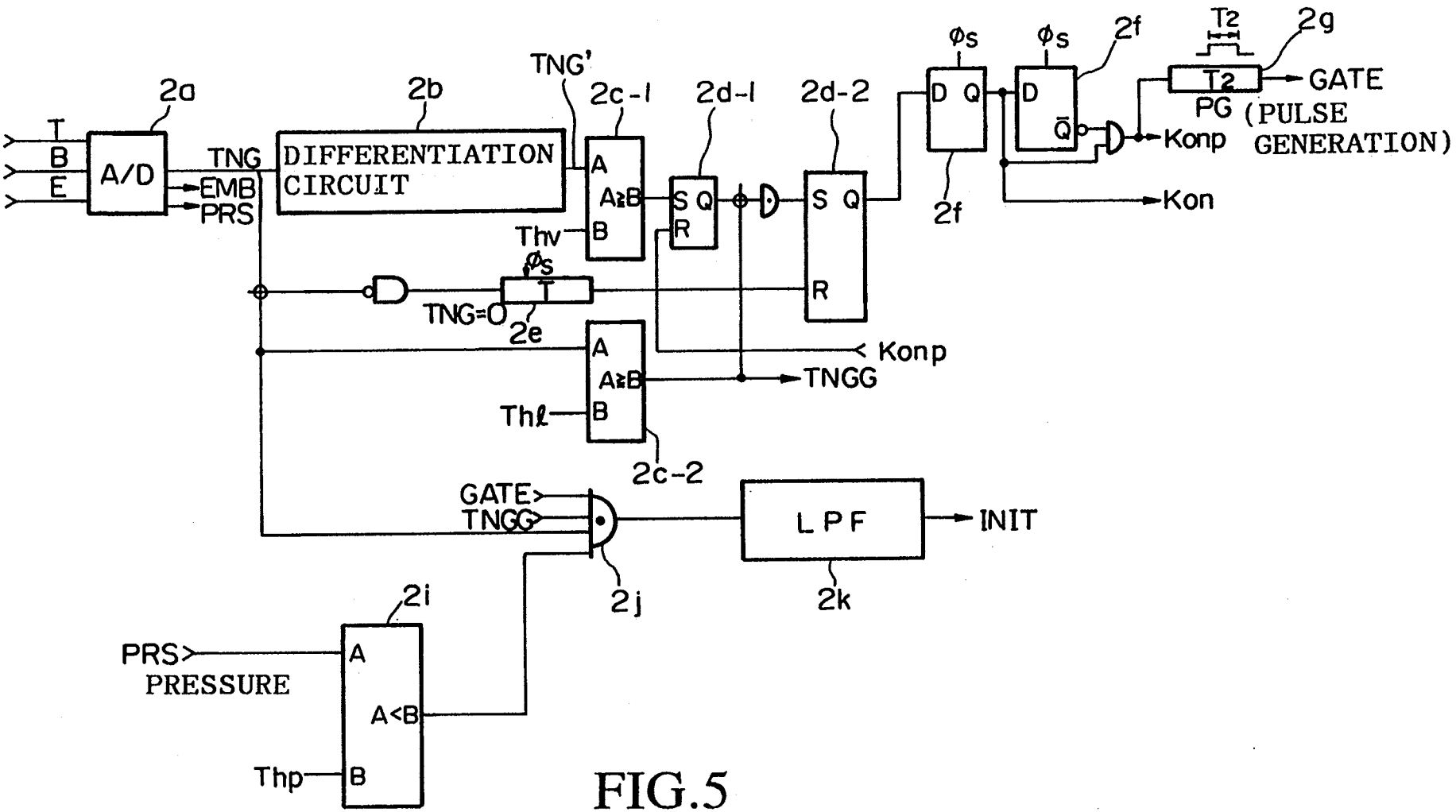
FIG. 5 is a circuit diagram showing an example of a construction of excitation parameter formation circuit 2.

Next, FIG. 5 is a circuit diagram showing the construction of the excitation parameter generation circuit 2. In this diagram, reference numeral 2*a* indicates an A/D converter; here, the above-described tonguing signal T, playing pressure signal B, and embouchure signal E are converted into tonguing data TNG, playing data PRS and embouchure data EMB and outputted. Reference numeral 2*b* indicates a differential circuit which differentiates and outputs tonguing data TNG. The output of this differential circuit 2*b* is data TNG', which express the displacement speed of the "tongue". Reference numerals 2*c*-1 and 2*c*-2 indicate comparators. These comparators 2*c*-1 and 2*c*-2 compare the levels of signals supplied to input terminal A and input terminal B, and in the case in which A is greater than or equal to B, output a signal having a "H" level. Reference numerals 2*d*-1 and 2*d*-2 are SR flip-flops, and reference numeral 2*e* is a timer circuit. In the case in which the input signal has a level of "L" for a predetermined period T, in other words, when timing data TNG are not inputted during the period T, this timer circuit 2*e* generates and outputs a trigger pulse. Reference numerals 2*f*-1 and 2*f*-2 are D flip-flops, and reference numeral 2*g* indicates a pulse generation circuit. This pulse generation circuit 2*g* detects a leading edge of the input signal and generates and outputs a gate signal GATE having a pulse width with a period of $T_2$. Reference numeral 2*i* indicates a comparator, which compares the signal level supplied to input terminal A and input terminal B, and in the case in which A is less than B, outputs a signal having a "H" level. Reference numeral 2*j* indicates an AND gate, and reference numeral 2*k* indicates a low pass filter (LPF) for the purpose of waveform shaping.

Figure 4:
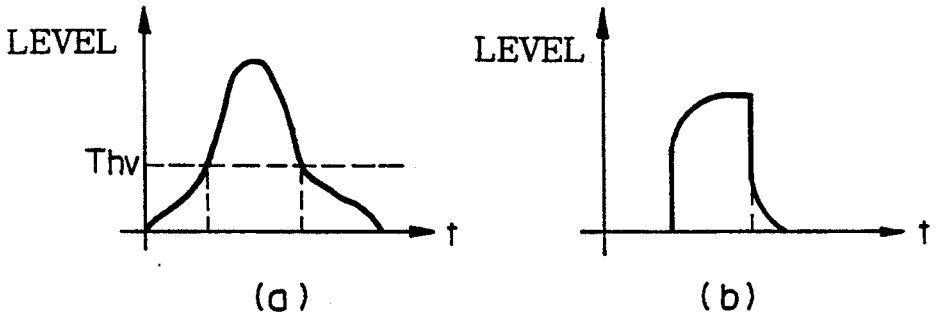
FIG. 4 is a diagram showing an example of the output of tonguing sensor 1e in the same preferred embodiment.

The excitation parameter generation circuit 2, having the above-described construction, first converts the various signals supplied from the woodwind musical instrument type operational element 1 into digital signals. Among the data obtained by means of this conversion, the above-described tonguing data TNG are differentiated, and become data TNG', which indicates the displacement speed of the "tongue" of the player. The data TNG' and tonguing data TNG are compared with threshold values Thv and Thl respectively. These threshold values Thv and Thl are data corresponding to predetermined displacement speeds and positions. Here, for example, in the case in which the "tongue" is displaced as shown in FIG. 4(*a*), data TNG' are outputted as shown in FIG. 4(*b*). Then, the time at which the comparison conditions of the comparators 2*c*-1 and 2*c*-2 are fulfilled, in other words, the initial timing at which the differential velocity and position of the "tongue" of the player exceed threshold values Thv and Thl, is detected by means of main circuit elements 2*d*18 2*g*. By means of this, key on signal Kon, key on pulse signal Konp, gate signal GATE, and tonguing gate signal TNGG, which indicate the beginning of tone generation, are created.

Figure 6:
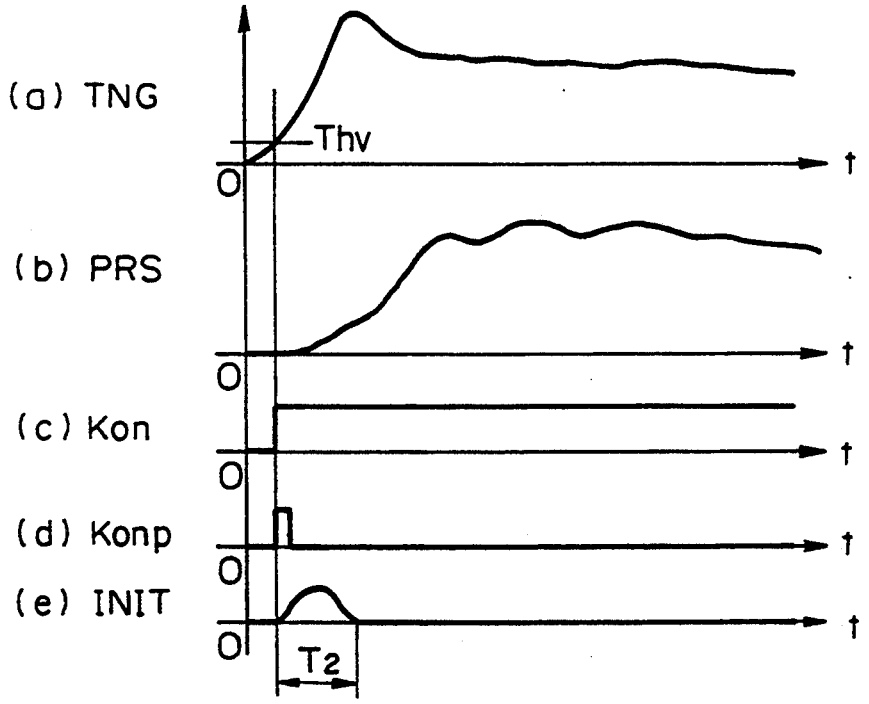
FIG. 6 is a diagram for the purpose of explanation of the operation of excitation parameter formation circuit 2.

Now, for example, in the case in which tonguing data TNG and playing pressure data PRS such as that shown in FIG. 6(*a*) and (*b*) is caused by the player, the key on signal Kon and key on pulse signal Konp shown in FIGS. 6(*c*) and (*d*) are created, and are supplied to AND gate 2*j*. Next, the output signal of AND gate 2*j* is passed through low pass filter (LPF) 2*k* and thus acquires the waveform of this filter, and becomes initial data INIT (see FIG. 6(*e*)). This initial data INIT is data corresponding to the initial displacement of the reed. In the case in which tonguing data TNG are not inputted during the period of the predetermined time T, a trigger pulse is outputted from timer circuit 2*e*. As a result, the SR flip-flop 2*d*-2 is reset and key on signal Konp begins.

Figure 7:
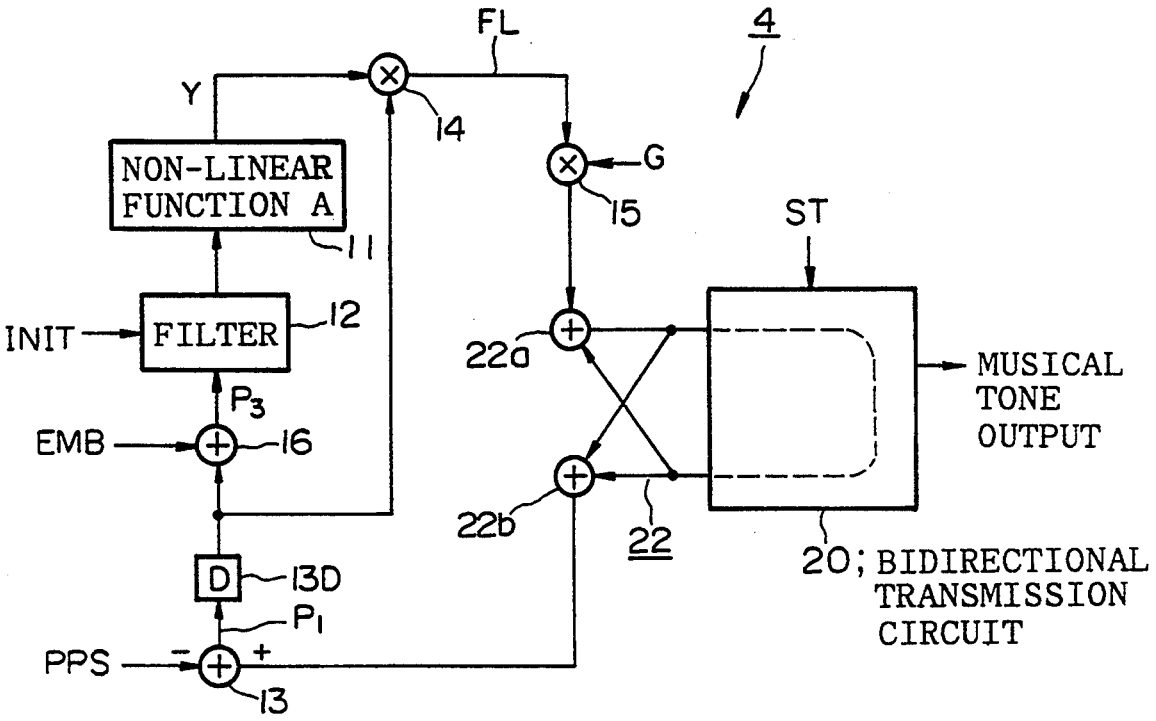
FIG. 7 is a block diagram showing an example of the structure of waveguide network 4.
Figure 10:
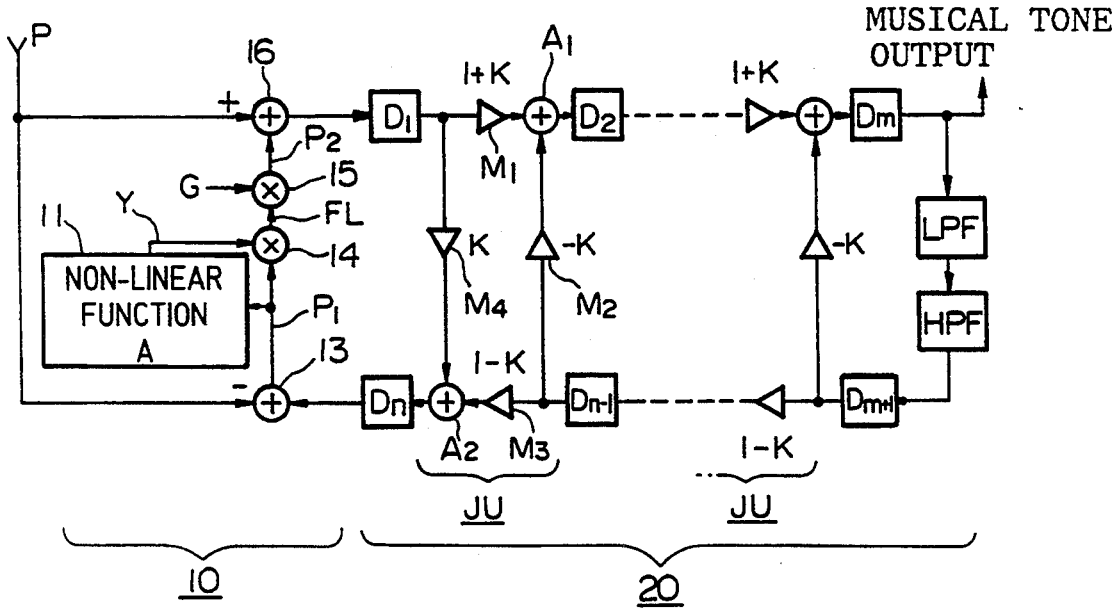
FIG.10 (PRIOR ART)
FIGS. 10 and 11 are diagrams for the purpose of the explanation of conventional examples.
Figure 11:
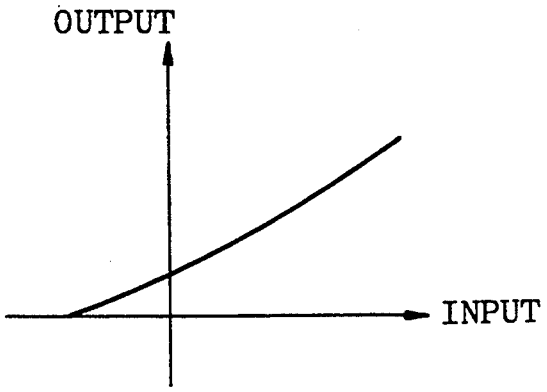
FIG.11 (PRIOR ART)

Next, the construction of waveguide network 4 will be explained with reference to FIG. 7. In the diagram, parts corresponding to those of the above-described FIG. 10 are identically numbered, and explanation thereof will be here omitted. First, the data ST for pitch control which are supplied to this waveguide network 4 have the signal propagation delay time thereof switched in bidirectional transmission circuit 20. By means of this, the resonance frequency is switched in bidirectional transmission circuit 20, and pitch is controlled. Junction 22 comprises adders 22*a* and 22*b*; in this junction 22, the output data of multiplier 15 and bidirectional transmission circuit 20 are added by means of adder 22*a* and this is inputted into bidirectional transmission circuit 20. Furthermore, the output data of bidirectional transmission circuit 20 and adder 22*a* are added by means of adder 22*b*, and this is outputted to subtracter 13. By proceeding in this manner, the scattering of the air pressure waves at the end part of the mouthpiece side in the resonance tube is simulated.

In the same manner as in the case of the above-described FIG. 10, playing pressure data PRS are inputted into subtracter 13, and the feedback data from bidirectional transmission circuit 20 (these data correspond to the air pressure waves which are reflected at the terminal end of the resonance tube and return to the mouthpiece side) are inputted into subtracter 13 through the medium of adder 22*b* of junction 22. Then, the data $P_1$, corresponding to the air pressure in the space between the mouthpiece and the reed are outputted from subtracter 13, and these data $P_1$ are inputted into adder 16 and multiplier 14 through the medium of delay circuit 13D. In adder 16, the above described embouchure data EMB are added to data P1 as an offset. As a result, data $P_3$, corresponding to the pressure actually placed on the reed, are outputted from adder 16. These data $P_3$ are band restricted by means of filter 12 and inputted into ROM 11 (nonlinear function A).

Figure 8:
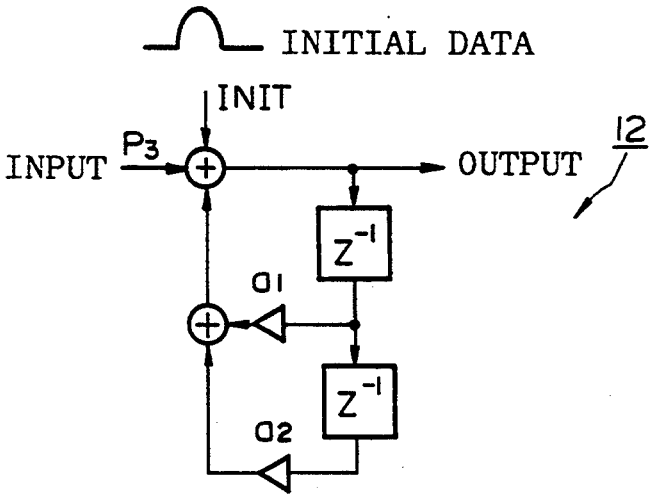
FIGS. 8 and 9 are circuit diagrams showing examples of the construction of filters 12.
Figure 9:
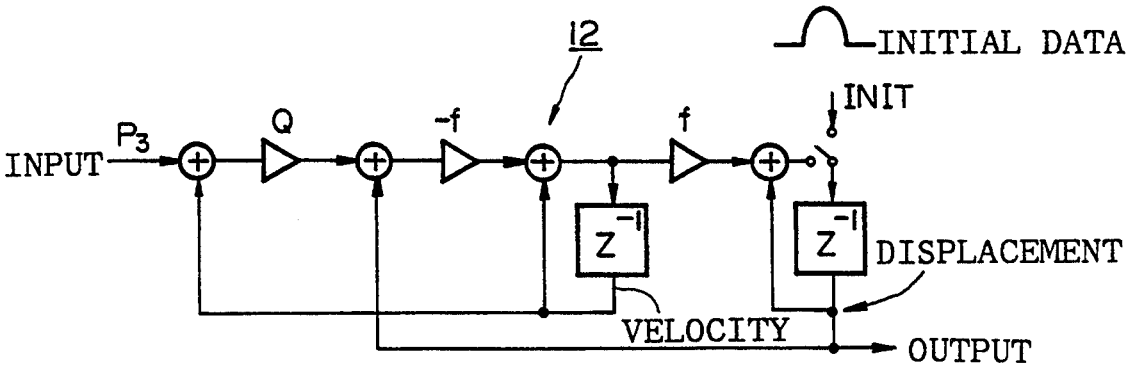

Here, filter 12 will be explained with reference to FIGS. 8 and 9. The filter 12 shown in these diagrams is a secondary filter comprising a delay memory, coefficient multipliers, and adders, and simulates the dynamics of the reed. That is, in the actual reed, when the pressure placed on the reed varies, the reed itself has inertia and the like, so that delay is produced in the displacement of the reed. Furthermore, in the case in which the frequency of this pressure variation is high, the reed does not respond. In filter 12, band restriction is conducted so as to simulate the displacement of the reed in correspondence to this type of pressure variation. In addition, in filter 12, the construction is such that the above-described initial data INIT is sent by means of addition or input switching, as shown in FIGS. 8 and 9. By proceeding in this manner, the reed has an initial displacement at the beginning of tone generation, so that it is possible to quickly and accurately generate musical tones.

The data outputted from this type of filter 12 are supplied to the ROM 11, which stores nonlinear function A. Data Y, which correspond to the admittance corresponding to the air flow in the space between the mouthpiece and the reed, are read out from this ROM 11. This data Y is multiplied by the data P1, which were inputted through the medium of delay circuit 13D, and data FL, which correspond to the flow speed of the air flow passing through the space between the mouthpiece and the reed, are outputted. Next, these data FL are multiplied by constant G by means of multiplier 15. This constant G corresponds to the impedance with respect to the air flow, as described above, and by means of this multiplication, data corresponding to the air pressure within the tube are obtained. Next, the data corresponding to the air pressure within the tube are inputted into the bidirectional transmission circuit 20 through the medium of adder 22*a* of junction 22. Next, the output data from bidirectional transmission circuit 20 are inputted into adder 13 through the medium of junction 22, and signal processing, which is identical to that described above, is repeatedly conducted.

In musical tone synthesizing apparatuses having the above-described construction, at the beginning of musical tone generation, the signal is circulated in accordance with the above-described initial data INIT, and resonant operation is quickly conducted. By means of this, the time lag at the time of musical tone generation, which was a problem conventionally, disappears. Moreover, resonance is conducted in correspondence with the waveform width of the initial data INIT, so that musical tones are generated only in a desired mode (resonance frequency of the tube). For example, if the waveform width of initial data INIT is shortened, the waveform will be changed to the succeeding higher harmonic overtone containing the high frequency portion. In addition, if the waveform width is lengthened, in contrast, the waveform will be changed to the previous harmonic overtone containing the low frequency portion.

In addition, after this type of tone generation has been carried out, control which is based on the physical values imparted to the actual woodwind musical instrument is conducted by means of playing pressure data PRS, embouchure data EMB, and key on signal Kon, and as a result, the musical tone synthesis of a woodwind musical instrument is conducted.

Second Preferred Embodiment

In the above-described first preferred embodiment, in order to be able to reproduce the tonguing performance method, initial data INIT were created based on tonguing data TNG. However, in place of this, in the second preferred embodiment, initial data INIT are generated based on embouchure data EMB. In this case, it is permissible to impart an initial displacement to the reed in correspondence with embouchure data EMB.

Furthermore, in the above-described first preferred embodiment, initial data INIT were obtained through the medium of low pass filter 2*k* (see FIG. 5); however, in place of this, in the second preferred embodiment, the initial data INIT are created through the medium of a band pass filter having as a central frequency thereof a desired resonance frequency.

Third Preferred Embodiment

In the third preferred embodiment, in the case in which a state is detected in which the "tongue" touches the reed, the resonance frequency of the filter 12 which simulates the reed is lowered, and a state in which the reed is damped is simulated. By proceeding in this manner, it is possible to impart a rapid release, and this type of performance method is sometimes used in actual musical instruments as a staccato effect.

What is claimed is:

1. A musical tone synthesizing apparatus comprising:

performance data generation means for generating performance data in accordance with a performance operation, excitation means for generating an excitation signal corresponding to said performance data, including means for generation an initial excitation signal having a pulse width which is short relative to said excitation signal, and wave transmission means, including at least two paths, a junction, means for delaying said excitation signal by a predetermined time, and means for extracting the excitation signal, for repeatedly circulating said excitation signal and for outputting the repeatedly circulated excitation signal, wherein said performance data operation means supplies a performance initiation signal to said excitation means during initial generation of said musical tone signal, and wherein said excitation means generates said initial excitation signal in response thereto so as to excite said wave transmission means.

2. A musical tone synthesizing apparatus in accordance with claim 1, in which said wave transmission means resonates at a predetermined resonance frequency in response to said initial excitation control signal.

3. A musical tone synthesizing apparatus in accordance with claim 1, in which said performance data generation means generates a tonguing signal as said performance initiation signal, and provides it to the means for generating an initial excitation control signal, said tonguing signal expressing a position of a tongue of a player with respect to a reed of a wind instrument.

4. A musical tone synthesizing apparatus in accordance with claim 3, in which said excitation means generates a signal indicating a beginning of tone generation based on said tonguing signal.

5. A musical tone synthesizing apparatus in accordance with claim 1, in which said initial excitation control signal corresponds to an initial displacement of a reed of a wind instrument at the time of musical tone generation.

* * * * *